US011086263B1

(12) United States Patent
Tanaka et al.

(10) Patent No.: US 11,086,263 B1
(45) Date of Patent: Aug. 10, 2021

(54) ROTATABLE CLEANING DEVICE FOR PHOTOCONDUCTOR DRUM THAT PREVENTS SPILLAGE

(71) Applicant: FUJIFILM BUSINESS INNOVATION CORP., Tokyo (JP)

(72) Inventors: Arichika Tanaka, Kanagawa (JP); Toyohiko Awano, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/922,058

(22) Filed: Jul. 7, 2020

(30) Foreign Application Priority Data

Mar. 12, 2020 (JP) ..... JP2020-042555

(51) Int. Cl.
*G03G 21/00* (2006.01)

(52) U.S. Cl.
CPC ..... *G03G 21/0035* (2013.01)

(58) Field of Classification Search
CPC ..... G03G 21/0011; G03G 21/0035; G03G 21/10; G03G 21/12; G03G 21/169
USPC ..... 399/123, 345, 349, 353, 358, 360
See application file for complete search history.

(56) References Cited

U.S. PATENT DOCUMENTS 5,442,422 A * 8/1995 Owens, Jr. et al. ..... G03G 21/0005 399/353
5,669,041 A * 9/1997 Thayer et al. ..... G03G 21/0035 399/353

FOREIGN PATENT DOCUMENTS

JP 3137795 B2 2/2001

* cited by examiner

*Primary Examiner* — William J Royer
(74) *Attorney, Agent, or Firm* — Oliff PLC

(57) ABSTRACT

A cleaning device includes an accommodating container, a collector, and a remover. The accommodating container has an opening and a receiving port. The collector is in contact with a surface of a cleaned body while rotating, to remove matter on the surface of the cleaned body. The remover has a tip end that is in contact with the surface of the cleaned body to remove the matter. The accommodating container accommodates the collector and the remover. The collector and the remover are exposed to the cleaned body through the opening. The accommodating container receives, through the receiving port, the matter removed from the cleaned body. The accommodating container is supported in such a manner that the accommodating container can rotate to a position where the matter collected in the accommodating container do not leak through the opening, so as to be separated from the cleaned body.

16 Claims, 8 Drawing Sheets

ROTATABLE CLEANING DEVICE FOR PHOTOCONDUCTOR DRUM THAT PREVENTS SPILLAGE

CROSS-REFERENCE TO RELATED APPLICATIONS

This application is based on and claims priority under 35 U.S.C. 119 from Japanese Patent Application No. 2020-042555 filed Mar. 12, 2020.

BACKGROUND

1. Technical Field

The present disclosure relates to a cleaning device and an image forming apparatus.

2. Related Art

An image forming apparatus has been known that includes an image carrier, a cleaning unit, and a toner collector. The image carrier carries a toner image. The cleaning unit comes into contact with the image carrier to remove a toner on the image carrier. The cleaning unit separably contacts the image carrier. The toner image on the image carrier is transferred to a recording material. When the cleaning unit is separated from the image carrier, the toner collecting unit comes into contact with the image carrier to collect the toner dropping off from a contact portion between the cleaning unit and the image carrier. The toner collector is detachably attached to a main body of the image forming apparatus.

SUMMARY

Aspects of non-limiting embodiments of the present disclosure relate to preventing scattering and spill of a waste toner in a cleaning device when the cleaning device is separated from a cleaned body.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a cleaning device including an accommodating container, a collector, and a remover. The accommodating container has an opening and a receiving port. The collector is in contact with a surface of a cleaned body while rotating, so as to remove matters to be collected on the surface of the cleaned body. The remover has a tip end that is in contact with the surface of the cleaned body so as to remove matter on the surface of the cleaned body. The accommodating container accommodates the collector and the remover. The collector and the remover are exposed to the cleaned body through the opening. The accommodating container receives, through the receiving port, the matter removed from the cleaned body by the collector and the remover. The accommodating container is supported in such a manner that the accommodating container can rotate to a position where the matter collected in the accommodating container does not leak through the opening, so as to be separated from the cleaned body.

BRIEF DESCRIPTION OF THE DRAWINGS

Exemplary embodiment(s) of the present disclosure will be described in detail based on the following figures, wherein.

DETAILED DESCRIPTION

Next, an exemplary embodiment and an example will be described in more detail with reference to the accompanying drawings. It is noted that the present disclosure is not limited to the exemplary embodiment and the example.

It is also noted that in the following description made with reference to the accompanying drawings, the drawings are schematic and ratios of dimensions or the like of elements are different from actual ones. Illustration of elements and members other than those necessary for the description may be omitted as appropriate for the sake of easy understanding.

Figure 1:
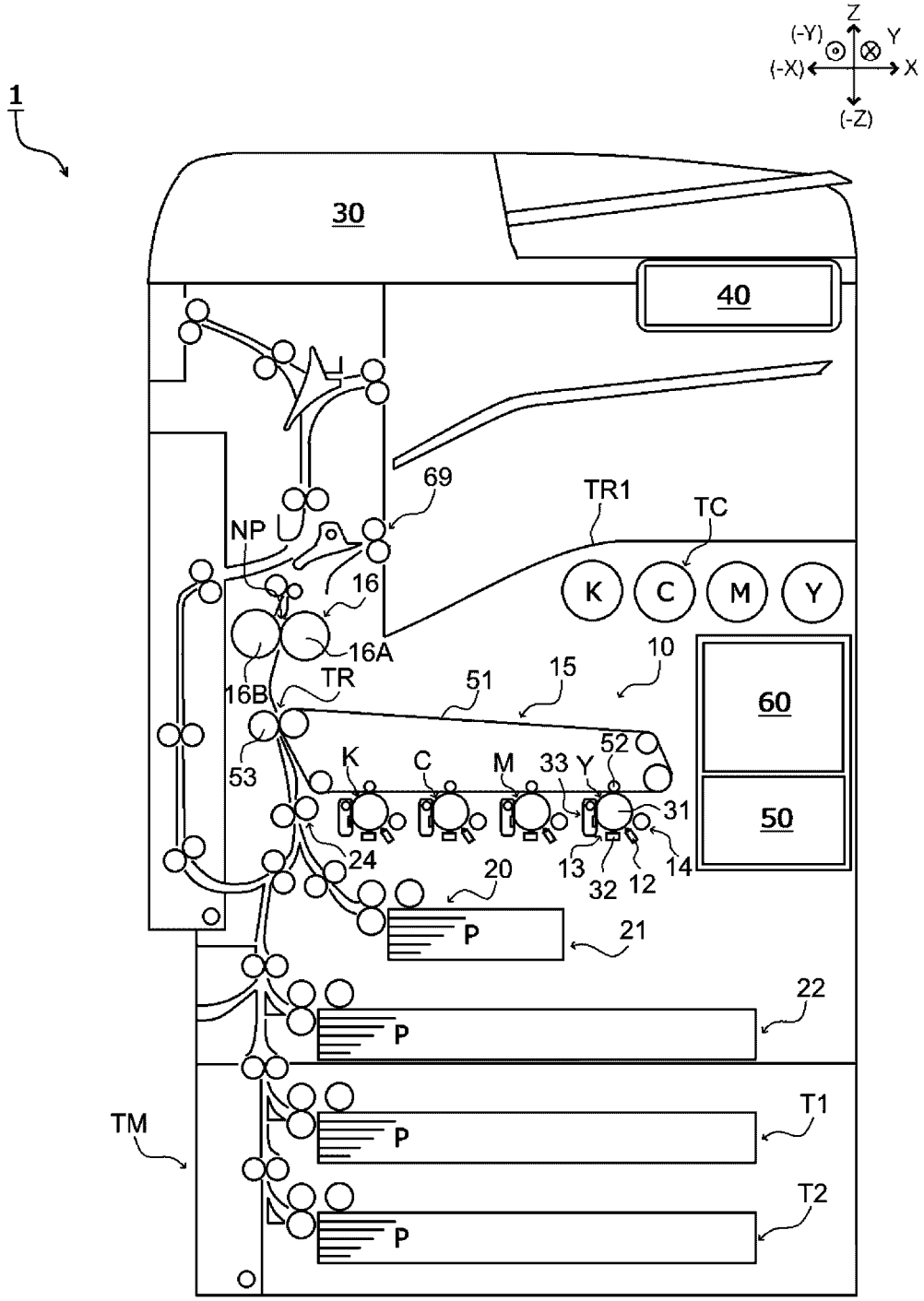
FIG. 1 is a schematic cross-sectional view illustrating an internal configuration of an image forming apparatus according to an exemplary embodiment.
Figure 2:
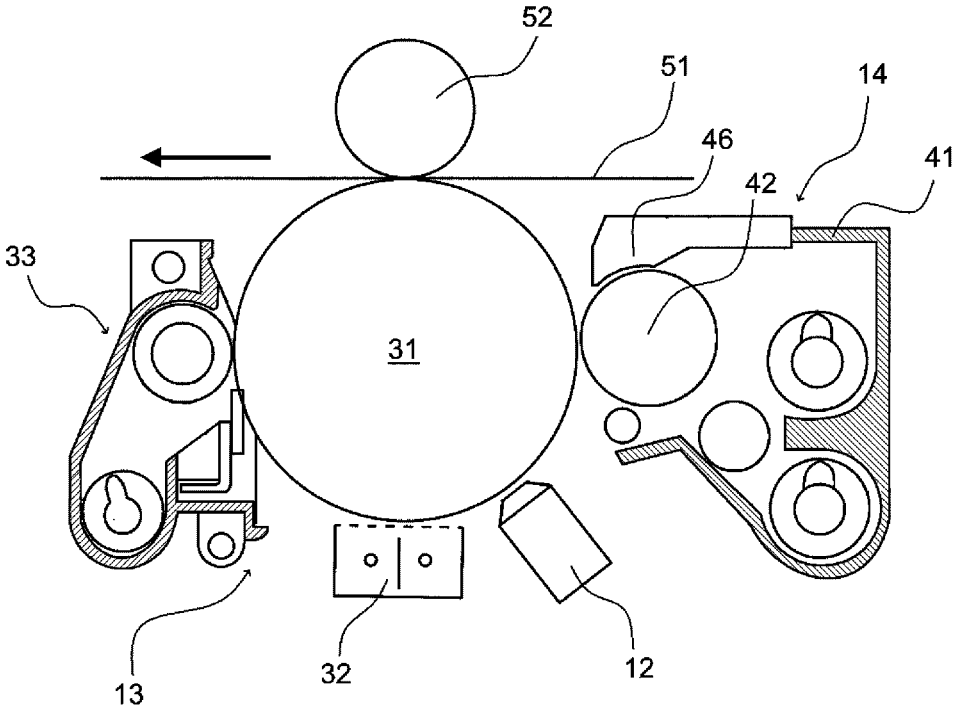
FIG. 2 is a schematic cross-sectional view illustrating a configuration of a photoconductor unit and a developing device.

(1) Overall Configuration and Operation of Image Forming Apparatus (1.1) Overall Configuration of Image Forming Apparatus FIG. 1 is a schematic cross-sectional view illustrating an internal configuration of an image forming apparatus 1 according to the exemplary embodiment. FIG. 2 is a schematic cross-sectional view illustrating a configuration of a photoconductor unit 13 and a developing device 14.

The image forming apparatus 1 includes an image forming device 10, a sheet feeding device 20, a reading device 30, an operation display 40, an image processor 50, and a system controller 60. The sheet feeding device 20 is attached to a lower portion of the image forming device 10. The reading device 30 is attached to an upper portion of the image forming device 10. When the image forming apparatus 1 performs a print function or a copy function, an image is formed on a recording medium such as a sheet.

The image forming device 10 includes exposure devices 12, photoconductor units 13, developing devices 14, a transfer device 15, a fixing device 16, and a toner supply device (not illustrated). The image forming device 10 forms a toner image on the sheet fed from the sheet feeding device 20 based on image information received from the image processor 50.

The sheet feeding device 20 including sheet trays 21, 22 is disposed at a bottom portion of the image forming device 10. A tray module TM is disposed below the sheet feeding device 20. The tray module TM includes multiple (two in this exemplary embodiment) sheet trays T1, T2 that are stacked in up and down directions. The sheet trays T1, T2 accommodate sheets of paper indicated by P in FIG. 1. The tray module TM is connected to the image forming device 10 and feeds sheets to the image forming device 10.

The reading device 30 is disposed above the image forming device 10. The reading device 30 reads an image on a sheet by an image sensor (not illustrated) such as a charge coupled device (CCD) line sensor, and converts the image into image data that is electric signals.

The operation display 40 as a user interface is disposed on the front surface of the reading device 30. The operation display 40 includes a combination of a liquid crystal display panel, various operation buttons, and a touch panel. A user of the image forming apparatus 1 inputs various settings and instructions via the operation display 40. Various types of information are displayed on the liquid crystal display panel, for the user of the image forming apparatus 1.

The image processor 50 generates image data based on print information acquired from an external device (for example, a digital camera, a mobile terminal, a personal computer, or the like), and performs various types of image processing using the image data input by the reading device 30.

(1.2) Configuration and Operation of Image Forming Device 10

In the image forming apparatus 1 having the configuration described above, the sheet which is fed out from one of the sheet trays 21, 22, T1, and T2 designated from the sheet feeding device 20 by a print job for each sheet to be printed is sent to the image forming device 10 in accordance with a timing of image formation.

The photoconductor units 13 are arranged below an intermediate transfer belt 51 side by side. Each photoconductor unit 13 includes a photoconductor drum 31 that is driven to rotate. The photoconductor drum 31 serves as an image carrier. A charging device 32, the exposure device 12, the developing device 14, a primary transfer roller 52, and a cleaning device 33 are arranged along a rotation direction of the photoconductor drum 31.

The developing device 14 includes a developing housing 41 that contains a developer therein. A developing roller 42 is disposed in the developing housing 41. The developing roller 42 faces the photoconductor drum 31. A trimmer 46 that regulates a layer thickness of the developer is disposed near the developing roller 42 (see FIG. 2).

The developing devices 14 have substantially the same configuration except the developers contained in the developing housings 41. The developing devices 14 form toner images of yellow (Y), magenta (M), cyan (C), and black (K), respectively.

Replaceable toner cartridges TC (K, C, M, Y) each containing the developer (that is, a toner containing a carrier) are disposed above the developing devices 14. The developer can be supplied from each toner cartridge TC to a respective one of the developing devices 14.

The surface of the rotating photoconductor drum 31 is charged by the charging device 32. An electrostatic latent image is formed on the surface of the photoconductor drum 31 by latent image formation light emitted from the exposure device 12. The electrostatic latent image formed on the photoconductor drum 31 is developed into a toner image by the developing roller 42.

The transfer device 15 includes the intermediate transfer belt 51, the primary transfer rollers 52, and a secondary transfer roller 53. The toner images of the respective colors formed on the photoconductor drums 31 of the photoconductor units 13 are transferred onto the intermediate transfer belt 51 in a superimposed manner. The primary transfer rollers 52 sequentially transfer (primarily transfer) the toner images of the respective colors formed by the photoconductor units 13 onto the intermediate transfer belt 51. The secondary transfer roller 53 collectively transfers (secondarily transfers) the toner images of the respective colors, which are transferred onto the intermediate transfer belt 51 in the superimposed manner, onto the sheet.

The toner images of the respective colors formed on the photoconductor drums 31 of the photoconductor units 13 are sequentially electrostatically transferred (primarily transferred) onto the intermediate transfer belt 51 by the primary transfer rollers 52 to which a predetermined transfer voltage is applied from a power supply device (not illustrated) that is controlled by the system controller 60, so that superimposed toner images are formed in which the toner images of the respective colors are superimposed.

As the intermediate transfer belt 51 moves, the superimposed toner images on the intermediate transfer belt 51 are transported to a secondary transfer portion TR in which the secondary transfer roller 53 is disposed. When the superimposed toner images are transported to the secondary transfer portion TR, the sheet is supplied from the sheet feeding device 20 to the secondary transfer portion TR according to a timing of the transport of the superimposed toner image. A predetermined transfer voltage is applied to the secondary transfer roller 53 from the power supply device controlled by the system controller 60, and the superimposed toner images on the intermediate transfer belt 51 are collectively transferred to the sheet.

A residual toner on the surface of the photoconductor drum 31 is removed by the cleaning device 33 and collected in a waste toner container (not illustrated). The surface of the photoconductor drum 31 is charged again by the charging device 32.

In the fixing device 16, a fixing nip portion NP (fixing region) is formed by a pressure-contact region between a heating module 16A and a pressure module 16B.

The sheet on which the toner images are collectively transferred by the transfer device 15 is transported to the fixing nip portion NP of the fixing device 16 through a transport guide in a state in which the toner images are unfixed. The toner images are fixed to the sheet by an action of heating and pressurizing by the heating module 16A and the pressure module 16B.

The sheet on which the fixed toner image is formed is guided by the transport guide, is discharged from a pair of discharge rollers 69 to a sheet discharge tray TR1 on an upper surface of the image forming apparatus 1, and is accommodated there.

When duplex printing is performed in an automatic manner, the sheet is reversed and sent to the image forming device 10 again. After a toner image is transferred and fixed to the sheet, the sheet is discharged to the sheet discharge tray TR1.

Figure 3:
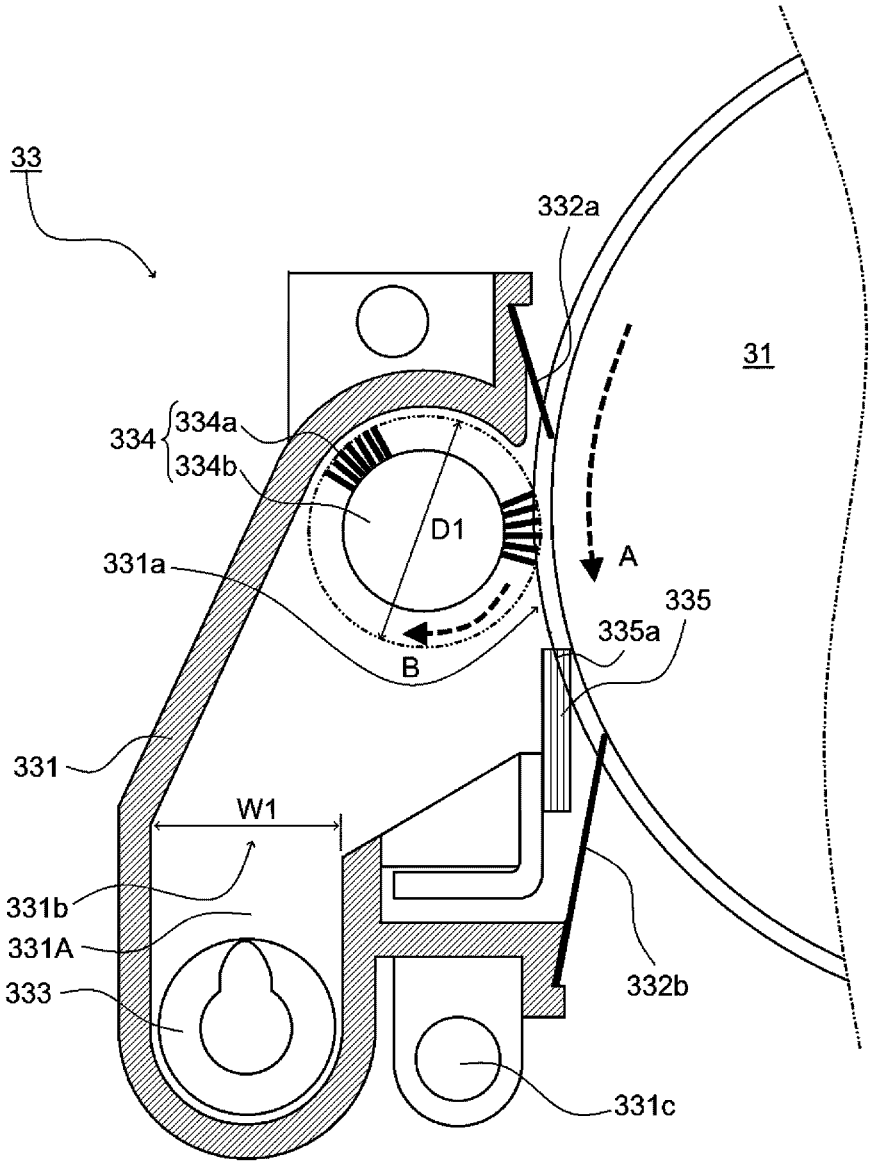
FIG. 3 is a schematic cross-sectional view illustrating a configuration of a cleaning device according to the exemplary embodiment.

(2) Configuration and Operation of Cleaning Device (2.1) Configuration of Cleaning Device FIG. 3 is a cross-sectional view illustrating a configuration of the cleaning device 33 according to the exemplary embodiment.

The cleaning device 33 includes a housing 331, a first seal member 332*a*, a second seal member 332*b*, a toner collection auger 333, a cleaning brush 334, and a cleaning blade 335. The housing 331 is disposed at a position where the housing 331 faces the photoconductor drum 31. The housing 331 is an example of an accommodating container. The first seal member 332*a* is supported at an upper edge portion of an opening 331*a* formed in the housing 331. The second seal member 332*b* is supported at a lower edge portion of the opening 331*a*. The toner collection auger 333 transports a waste toner collected in the housing 331. The cleaning brush 334 is in contact with the surface of the photoconductor drum 31. The cleaning brush 334 is an example of a collector. The cleaning blade 335 is disposed downstream of the cleaning brush 334 in the rotation direction of the photoconductor drum 31. The cleaning blade 335 is an example of a remover.

The cleaning device 33 is integrated with the photoconductor drum 31 and the like to constitute the photoconductor unit 13. The cleaning device 33 is detachably attached to the image forming apparatus 1.

The housing 331 accommodates the toner, paper dust, and the like removed and collected by the cleaning blade 335 or the cleaning brush 334 from the surface of the photoconductor drum 31. The housing 331 has the opening 331*a* at the position where the housing 331 faces the photoconductor drum 31. The cleaning blade 335 and the cleaning brush 334 are disposed in the opening 331*a* and are in contact with the photoconductor drum 31.

The first seal member 332*a* and the second seal member 332*b* are fixedly supported at end portions of the opening 331*a* of the housing 331. The first seal member 332*a* and the second seal member 332*b* seal a gap between the photoconductor drum 31 and the housing 331 to prevent the waste toner collected in the cleaning device 33 from leaking out of the cleaning device 33. Each of the first seal member 332*a* and the second seal member 332*b* are formed of, for example, a thermoplastic polyurethane film having a thickness of 0.1 mm.

As illustrated in FIG. 3, the housing 331 includes a container 331A having a receiving port 331*b*. The container 331A receives, through the receiving port 331*b*, the toner, the paper dust, and the like that are collected and removed from the surface of the photoconductor drum 31 by the cleaning blade 335 and the cleaning brush 334. The toner collection auger 333 is disposed in the container 331A.

The toner collection auger 333 includes a screw. The toner collection auger 333 transports the waste toner and the like, which are removed from the surface of the photoconductor drum 31 and accommodated in the housing 331, to a waste toner box (not illustrated) while agitating the waste toner and the like.

The cleaning blade 335 is made of a material having excellent mechanical properties such as abrasion resistance, chipping resistance, and creep resistance. For example, the cleaning blade 335 is made of urethane rubber such as thermosetting polyurethane rubber. The cleaning blade 335 is fixedly supported at the housing 331 by a metal plate having an L-shaped cross section. A tip end portion 335*a* of the cleaning blade 335 is in contact with the surface of the photoconductor drum 31 at a predetermined contact pressure to remove the toner, the paper dust, and the like from the surface of the photoconductor drum 31.

The cleaning brush 334 is disposed in the housing 331. The cleaning brush 334 is disposed upstream of the cleaning blade 335 in the rotation direction of the photoconductor drum 31 and upward of the cleaning blade 335 in the vertical direction. The cleaning brush 334 collects a part of the residual toner and the like on the photoconductor drum 31 into the housing 331, while agitating the residual toner and the like at a position in front of the cleaning blade 335.

The cleaning brush 334 includes a base cloth, brush bristles 334*a* and a metal shaft 334*b*. The bristles 334*a* are pile yarns raised on the base cloth. The brush bristles 334*a* are spirally wound around the shaft 334*b*, so that the cleaning brush 334 has a roller shape. In the present exemplary embodiment, the brush bristles 334*a* have, for example, a fiber diameter of 40 μm, a pile length of 2 mm, and a bristle density of 100,000/inch$^2$. The cleaning brush 334 is adjusted such that the contact amount (bite amount) of the cleaning brush 334 with respect to the surface of the photoconductor drum 31 is 1 mm.

The cleaning brush 334 is driven to rotate in a direction indicated by an arrow B in FIG. 3, that is, in an opposite direction to the rotation direction (an arrow A) of the photoconductor drum 31, so that the facing surfaces of the cleaning brush 334 and photoconductor drum 31 move in the same direction, that is, the cleaning brush 334 and the photoconductor drum 31 operate in a so-called "with mode". With this configuration, the brush bristles 334*a* of the cleaning brush 334 is in contact with the surface of the photoconductor drum 31 to scrape the residual toner and the like adhering to the surface of the photoconductor drum 31. The rotation speed of the cleaning brush 334 is substantially equal to that of the photoconductor drum 31.

An outer diameter D1 of the cleaning brush 334 is larger than a width W1 of the receiving port 331*b* of the housing 331 illustrated in FIG. 3. With this configuration, when the cleaning device 33 rotates about a rotation shaft 331*c* to separate from the photoconductor drum 31, the cleaning brush 334 moves downward to close the receiving port 331*b*. The cleaning brush 334 includes the brush bristles 334*a* which are the raised pile yarns. The brush bristles 334*a* come into contact with an edge portion of the receiving port 331*b* to bite into the edge portion of the receiving port 331*b*, so that it is possible to prevent the waste toner in the container 331A from leaking to the outside.

(2.2) Function and Operation of Cleaning Device

Figure 4:
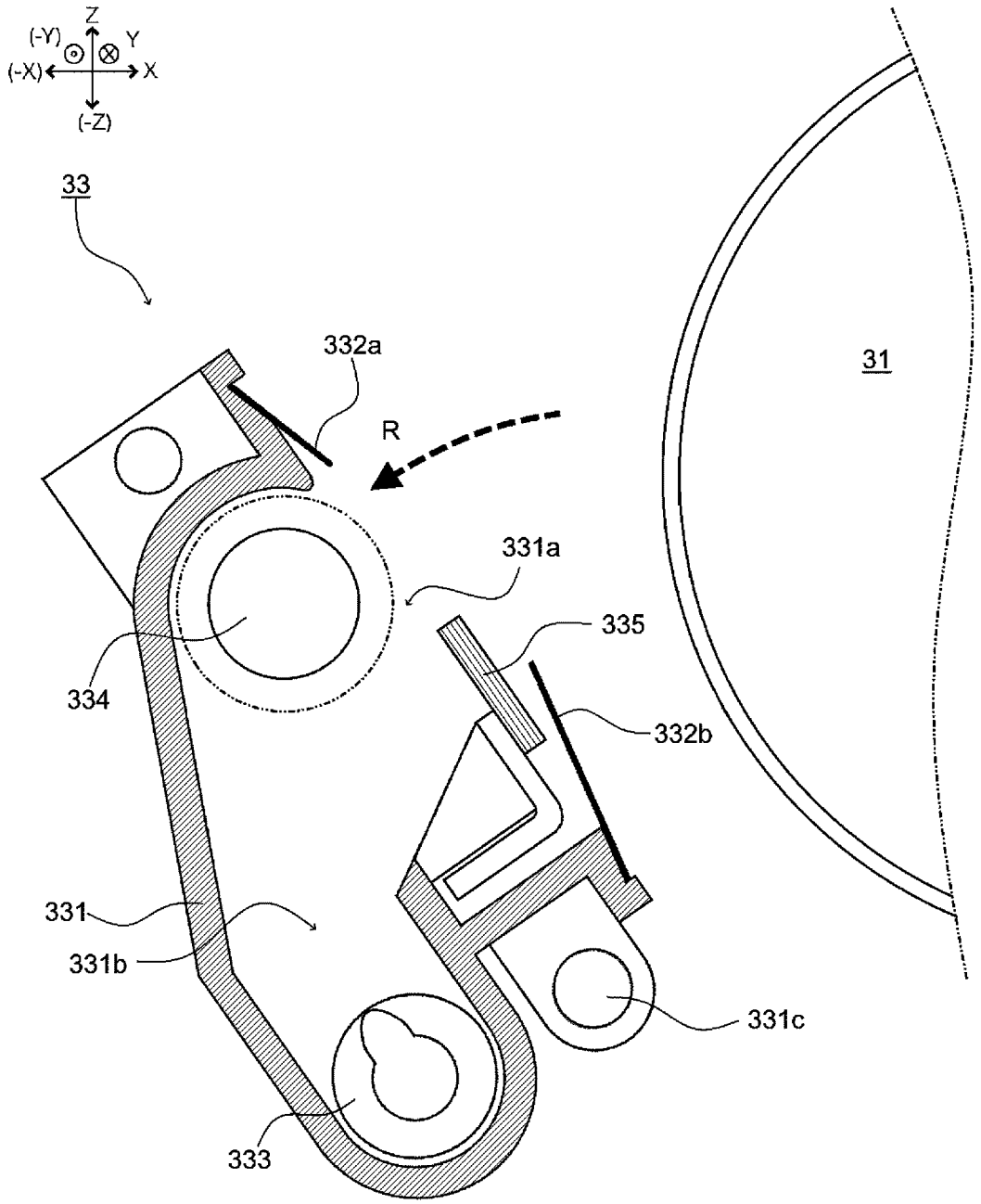
FIG. 4 is a schematic cross-sectional view illustrating the cleaning device separated from a photoconductor drum.
Figure 5:
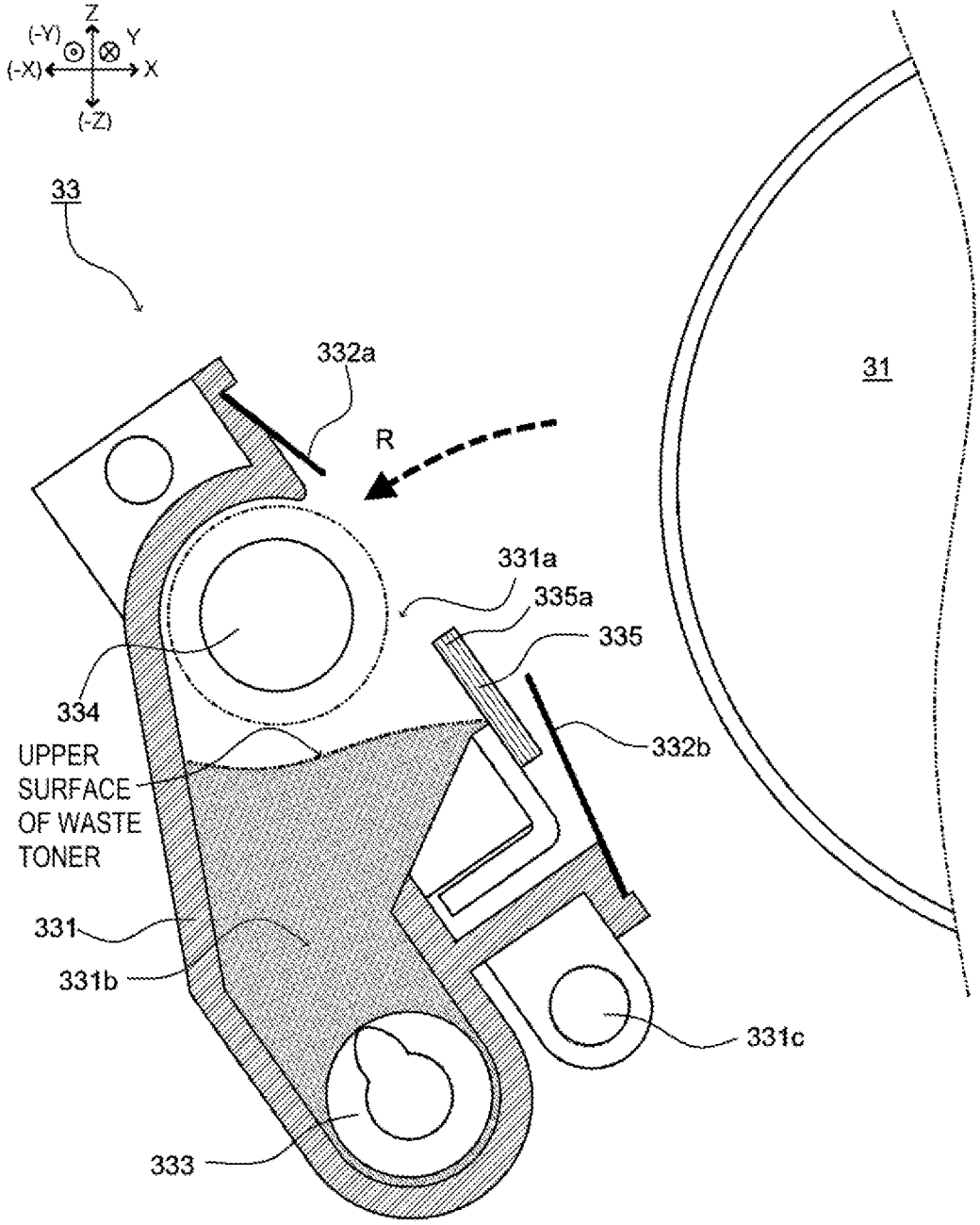
FIG. 5 is a schematic cross-sectional view illustrating the positional relationship between an upper surface of a waste toner and a tip end portion of a cleaning blade in the cleaning device separated from the photoconductor drum.
Figure 6:
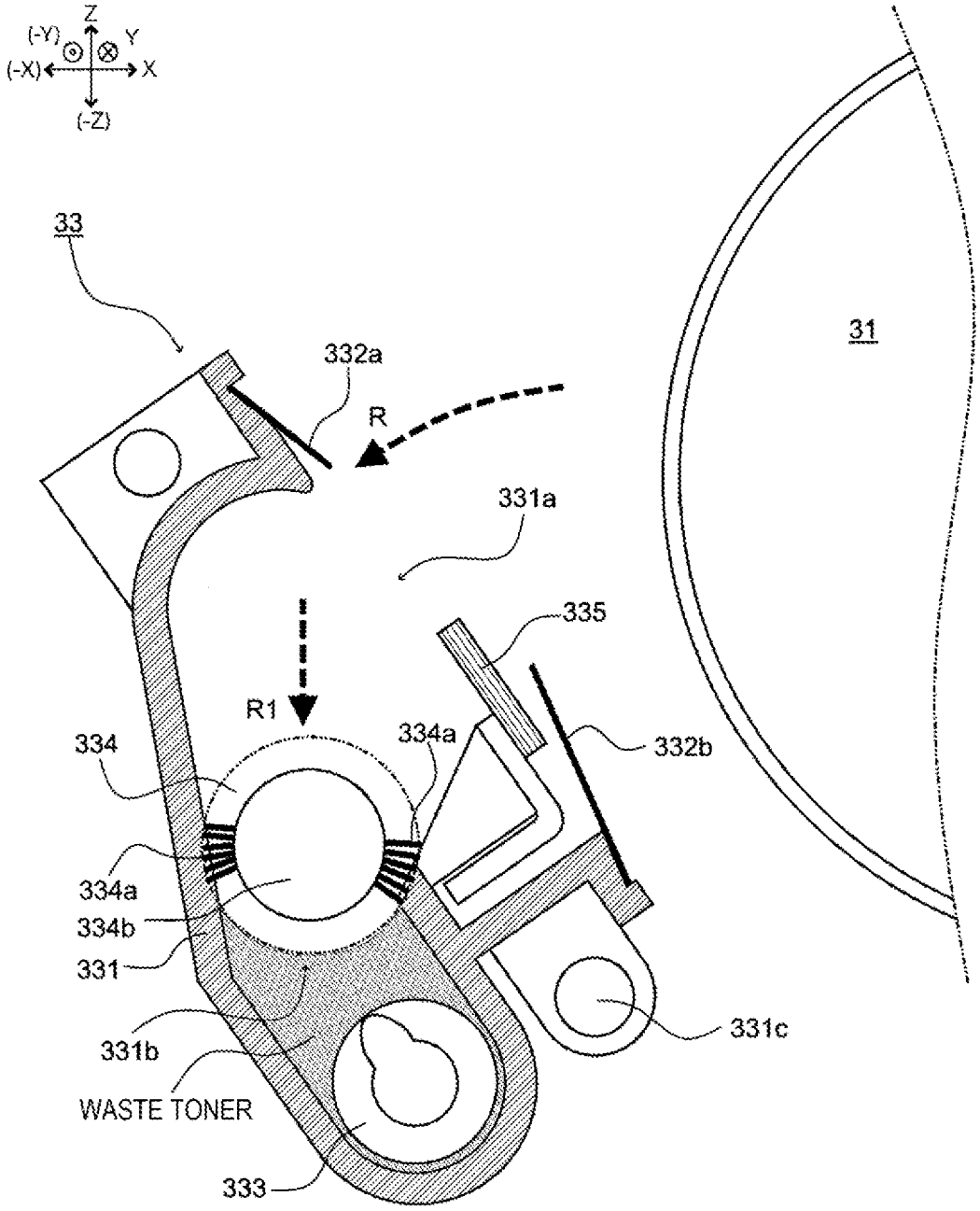
FIG. 6 is a schematic cross-sectional view illustrating an example of a state in which a receiving port of the cleaning device separated from the photoconductor drum is closed.
Figure 7:
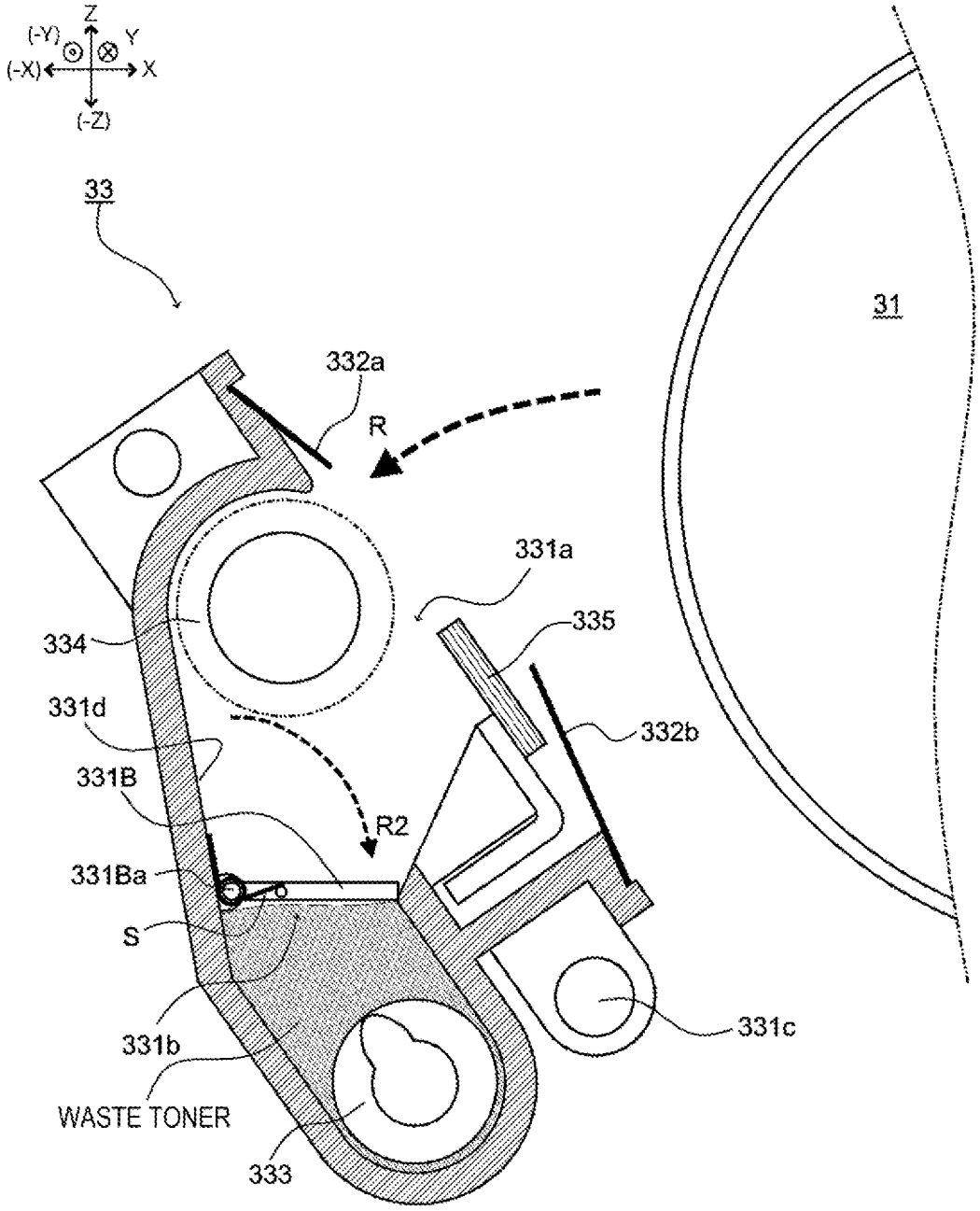
FIG. 7 is a schematic cross-sectional view illustrating a modification of the state in which the receiving port of the cleaning device separated from the photoconductor drum is closed.
Figure 8:
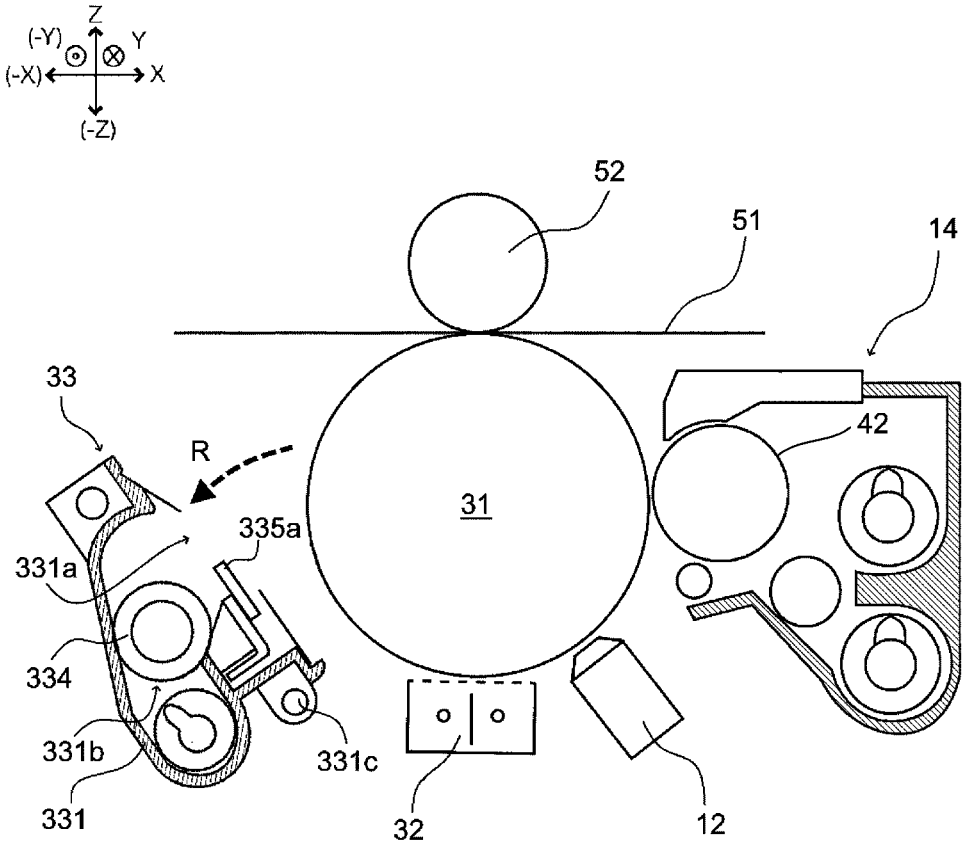
FIG. 8 is a view illustrating how to detach the cleaning device from the photoconductor unit.

FIG. 4 is a schematic cross-sectional view illustrating the cleaning device 33 separated from the photoconductor drum 31. FIG. 5 is a schematic cross-sectional view illustrating the positional relationship between an upper surface of the waste toner and the tip end portion 335*a* of the cleaning blade 335 in the cleaning device 33 separated from the photoconductor drum 31. FIG. 6 is a schematic cross-sectional view illustrating an example of a state in which the receiving port 331*b* of the cleaning device 33 separated from the photoconductor drum 31 is closed. FIG. 7 is a schematic cross-sectional view illustrating a modification of the state in which the receiving port 331*b* of the cleaning device 33 separated from the photoconductor drum 31 is closed. FIG. 8 is a view illustrating how to detach the cleaning device 33 from the photoconductor unit 13.

The cleaning device 33 removes matter to be collected on the photoconductor drum 31 after the toner image has been primarily transferred to the intermediate transfer belt 51. The matter to be collected includes residual developer (that is, the toner and an external additive) and foreign matter such as paper dust adhering to the photoconductor drum 31 from the sheet.

The cleaning brush 334 rotates clockwise as indicated by the arrow B in FIG. 3 with being in contact with the surface of the photoconductor drum 31 (the photoconductor drum 31 rotates counterclockwise as indicated by the arrow A in FIG. 3), so as to raise the matter to be collected on the photoconductor drum 31, which facilitates removal of the matter to be collected, and collect a part of the matter to be collected into the housing 331.

When the toner on the surface of the photoconductor drum 31 is little, the toner adhering to the cleaning brush 334 is supplied to the surface of the photoconductor drum 31 to reduce the frictional force between the cleaning blade 335 and the surface of the photoconductor drum 31.

The cleaning blade 335 scrapes the matter to be collected, which are raised by the cleaning brush 334 and are on the photoconductor drum 31, so as to remove the matter to be collected.

The toner collection auger 333 is disposed in the container 331A that is located at a lower portion of the housing 331. The toner collection auger 333 rotates so as to transport the collected waste toner along a rotation shaft of the toner collection auger 333.

Accordingly, the cleaning device 33 that collects the residual toner and the like on the photoconductor drum 31 is replaced separately from the photoconductor drum 31 of the photoconductor unit 13. When the cleaning device 33 is detached from the photoconductor unit 13 during replacement of the cleaning device 33, the waste toner accommodated in the cleaning device 33 might be scattered or spilled through the opening 331*a* of the cleaning device 33 depending on the orientation of the cleaning device 33.

The cleaning device 33 according to the present exemplary embodiment includes the rotation shaft 331*c* in the lower portion of the housing 331. The cleaning device 33 is supported in such a manner that the cleaning device 33 can rotate to a position where the waste toner collected in the housing 331 does not leak through the opening 331*a* of the housing 331, so as to be separated from the photoconductor drum 31.

As illustrated in FIG. 4, when the cleaning device 33 rotates about the rotation shaft 331*c* in a direction away from the photoconductor drum 31 (see an arrow R in FIG. 4), the opening 331*a* of the housing 331 sealed by the first seal member 332*a*, the second seal member 332*b*, and the photoconductor drum 31 is opened, but faces upward in the gravitational direction. The cleaning device 33 is removed with the opening 331*a* facing upward (in the Z direction) as described above, so that scattering and spillage of the waste toner through the opening 331*a* can be prevented.

In particular, as illustrated in FIG. 5, the cleaning device 33 is supported in such a manner that the cleaning device 33 can rotate to a position where the upper surface of the waste toner collected in the housing 331 is lower than the tip end portion 335*a* of the cleaning blade 335, so as to be separated from the photoconductor drum 31. As a result, the scattering and the spillage of the waste toner through the opening 331A can be prevented.

FIG. 6 illustrates a state in which when the cleaning device 33 rotates about the rotation shaft 331*c* in the direction away from the photoconductor drum 31, the cleaning brush 334 moves in the housing 331 to close the receiving port 331*b* of the housing 331. For example, when a support portion for the shaft 334*b* that is rotatably supported by the housing 331 is unlocked, the cleaning brush 334 falls downward (that is, in a −Z direction) by its own weight (see an arrow R1 in FIG. 6) to close the receiving port 331*b*. The cleaning brush 334 is an example of a closing unit.

The outer diameter D1 of the cleaning brush 334 is larger than the width W1 of the receiving port 331*b* of the housing 331. When the cleaning brush 334 falls downward, the brush bristles 334*a* come into contact with and bites into the edge portion of the receiving port 331*b*, and the cleaning brush 334 stops. Accordingly, scattering and spillage of the waste toner accommodated in the container 331A through the opening 331*a* can be prevented. A mechanism of moving the cleaning brush 334 is not limited to falling down by the weight of the cleaning brush 334. Various mechanisms may be employed to move the cleaning brush during the rotation of the cleaning device 33.

Modification

FIG. 7 illustrates an example of a closing unit according to a modification that closes the receiving port 331*b*.

When the cleaning device 33 rotates about the rotation shaft 331*c* in the direction away from the photoconductor drum 31, a lid 331B rotatably provided on an inner wall 331*d* of the housing 331 rotates to close the receiving port 331*b*.

Specifically, the lid 331*b* is held along the inner wall 331*d* of the housing 331 in a state where the lid 331*b* is urged by a torsion spring S so as to be rotatable about a rotation shaft 331Ba. The lid 331*b* is unlocked during the rotation of the cleaning device 33, so that the lid 331*b* rotates as indicated by an arrow R2 in FIG. 7 to close the receiving port 331*b*. Accordingly, scattering and spillage of the waste toner accommodated in the container 331A through the opening 331*a* can be prevented.

FIG. 8 illustrates replacement of the cleaning device 33.

The cleaning device 33 rotates to the position where the waste toner collected in the housing 331 does not leak through the opening 331*a* of the housing 331, so as to be separated from the photoconductor drum 31. Then, the cleaning device 33 is pulled out toward the front side (a −Y direction) of the image forming apparatus 1 for detachment. Accordingly, it is possible to prevent the waste toner accommodated in the housing 331 from being scattered and spilled through the opening 331*a*, and to prevent the tip end portion 335*a* (that is, an edge) of the cleaning blade 335 from being damaged.

The exemplary embodiments of the present disclosure have been described in detail. It is noted that the present disclosure is not limited to the above exemplary embodiments. Various modifications may be made within the scope of the gist of the present disclosure recited in the appended claims.

For example, in the exemplary embodiment, the cleaning device 33 of the photoconductor unit 13 has been described. The present disclosure is applicable to (i) a replaceable cleaning device in an intermediate transfer unit including an intermediate transfer belt and (ii) a replaceable cleaning device in a sheet transport unit including a transport belt.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A cleaning device comprising:

an accommodating container having an opening and a receiving port;

a collector that is in contact with a surface of a cleaned body while rotating, so as to remove matter to be collected on the surface of the cleaned body;

a closing unit configured to close the receiving port when the accommodating container rotates about a rotation shaft so as to be separated from the cleaned body; and a remover having a tip end that is in contact with the surface of the cleaned body so as to remove the matter on the surface of the cleaned body, wherein the accommodating container accommodates the collector, the closing unit, and the remover, the collector and the remover are exposed to the cleaned body through the opening, and the accommodating container receives, through the receiving port, the matter removed from the cleaned body by the collector and the remover.

2. The cleaning device according to claim 1, wherein the collector is configured to move to close the receiving port when the accommodating container rotates about a rotation shaft so as to be separated from the cleaned body.

3. The cleaning device according to claim 2, wherein an outer diameter of the collector is larger than a width of the receiving port in a direction intersecting a rotational shaft direction of the accommodating container.

4. An image forming apparatus comprising:

the cleaning device according to claim 3; and an image carrier configured to carry a formed toner image, the image carrier being the cleaned body, wherein the cleaning device removes the matter on the image carrier.

5. An image forming apparatus comprising:

the cleaning device according to claim 2; and an image carrier configured to carry a formed toner image, the image carrier being the cleaned body, wherein the cleaning device removes the matter on the image carrier.

6. The cleaning device according to claim 1, wherein the collector is disposed upstream of the remover in a rotation direction of the cleaned body and upward of the remover in a vertical direction.

7. The cleaning device according to claim 1, wherein the cleaning device is detached from the cleaned body after being separated from the cleaned body.

8. An image forming apparatus comprising:

the cleaning device according to claim 1; and an image carrier configured to carry a formed toner image, the image carrier being the cleaned body, wherein the cleaning device removes the matter on the image carrier.

9. A cleaning device comprising:

an accommodating container having an opening and a receiving port;

a collector that is in contact with a surface of a cleaned body while rotating, so as to remove matter to be collected on the surface of the cleaned body, the collector being configured to move to close the receiving port when the accommodating container rotates about a rotation shaft so as to be separated from the cleaned body; and a remover having a tip end that is in contact with the surface of the cleaned body so as to remove the matter on the surface of the cleaned body, wherein the accommodating container accommodates the collector and the remover, the collector and the remover are exposed to the cleaned body through the opening, and the accommodating container receives, through the receiving port, the matter removed from the cleaned body by the collector and the remover.

10. The cleaning device according to claim 9, further comprising:

a closing unit configured to close the receiving port when the accommodating container rotates about a rotation shaft so as to be separated from the cleaned body.

11. An image forming apparatus comprising:

the cleaning device according to claim 10; and an image carrier configured to carry a formed toner image, the image carrier being the cleaned body, wherein the cleaning device removes the matter on the image carrier.

12. The cleaning device according to claim 9, wherein an outer diameter of the collector is larger than a width of the receiving port in a direction intersecting a rotational shaft direction of the accommodating container.

13. An image forming apparatus comprising:

the cleaning device according to claim 12; and an image carrier configured to carry a formed toner image, the image carrier being the cleaned body, wherein the cleaning device removes the matter on the image carrier.

14. The cleaning device according to claim 9, wherein the collector is disposed upstream of the remover in a rotation direction of the cleaned body and upward of the remover in a vertical direction.

15. The cleaning device according to claim 9, wherein the cleaning device is detached from the cleaned body after being separated from the cleaned body.

16. An image forming apparatus comprising:

the cleaning device according to claim 9; and an image carrier configured to carry a formed toner image, the image carrier being the cleaned body, wherein the cleaning device removes the matter on the image carrier.

* * * * *